US009216128B2

(12) United States Patent
Richardson

(10) Patent No.: US 9,216,128 B2
(45) Date of Patent: Dec. 22, 2015

(54) HUMAN REMAINS BAG WITH FILTRATION UNIT

(71) Applicant: Michael P Richardson, Anderson, SC (US)

(72) Inventor: Michael P Richardson, Anderson, SC (US)

(73) Assignee: TRAILERLOGIC, LLC, Greenville, SC (US)

( * ) Notice: Subject to any disclaimer, the term of this patent is extended or adjusted under 35 U.S.C. 154(b) by 0 days.

(21) Appl. No.: 13/827,648

(22) Filed: Mar. 14, 2013

(65) Prior Publication Data

US 2014/0259577 A1 Sep. 18, 2014

(51) Int. Cl.
*A61G 17/06* (2006.01)
*A61G 17/007* (2006.01)

(52) U.S. Cl.
CPC ..... *A61G 17/06* (2013.01); *A61G 17/007* (2013.01)

(58) Field of Classification Search
CPC ... A61G 17/002; A61G 17/06; A61G 7/1055; A61G 17/007; B65D 33/01; B65D 33/04; B65D 33/06; B65D 33/2591; B65D 77/225; B65D 2205/00
USPC ..... 27/11, 28; 190/103; 383/66, 100, 103, 383/106, 113
See application file for complete search history.

(56) References Cited

U.S. PATENT DOCUMENTS

| | | | | |
|---|---|---|---|---|
| 3,435,494 | A * | 4/1969 | Bernard | 27/11 |
| 4,780,940 | A * | 11/1988 | Jay | 27/28 |
| 4,790,051 | A * | 12/1988 | Knight | 27/28 |
| 4,902,521 | A * | 2/1990 | Rosenfeld | 426/112 |
| 4,922,562 | A * | 5/1990 | Allred et al. | 5/627 |
| 5,341,548 | A * | 8/1994 | Zerick | 27/28 |
| 5,659,932 | A * | 8/1997 | Wright | 27/7 |
| 5,659,933 | A | 8/1997 | McWilliams | |
| 7,228,603 | B2 * | 6/2007 | Craig | 27/28 |
| 7,337,511 | B2 * | 3/2008 | Yu et al. | 27/28 |
| 7,484,275 | B2 * | 2/2009 | Carroll et al. | 27/28 |
| 8,522,939 | B2 * | 9/2013 | Rowe | 190/112 |
| 8,966,726 | B2 * | 3/2015 | Chua | A61G 17/06 27/28 |
| 2008/0307822 | A1 * | 12/2008 | Richardson | 62/376 |
| 2009/0118562 | A1 * | 5/2009 | Cole | A61L 2/238 588/313 |
| 2011/0272231 | A1 * | 11/2011 | Hoberman et al. | 190/103 |

OTHER PUBLICATIONS

"User Instructions for 3MJupiter™ JFR-85-CE and JFR-T1 Filters," 3M United Kingdom P.L.C.

* cited by examiner

*Primary Examiner* — William Miller
(74) *Attorney, Agent, or Firm* — Nelson Mullins Riley & Scarborough LLP

(57) ABSTRACT

The present invention is directed to a closeable container for storing a cadaver where the container has a passthrough unit that may allow for filtration and includes an opeanable one-way flow valve that allows for fluids such as gas to travel only from inside the container to the exterior of the container. The passthrough unit includes a coupling for mating with an air purifying canister or cartridge.

22 Claims, 10 Drawing Sheets

*FIG. –1–*

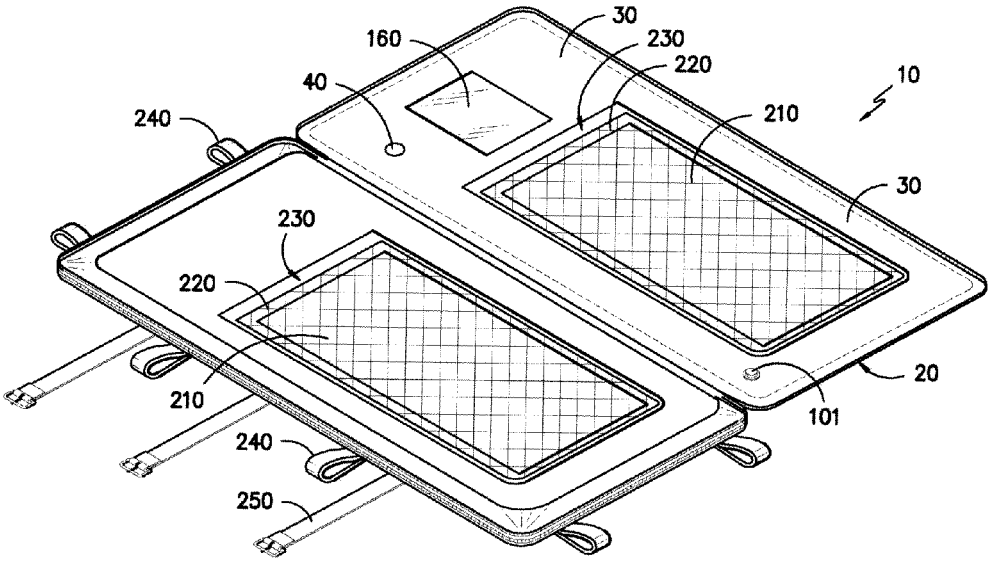
*FIG. –4–*

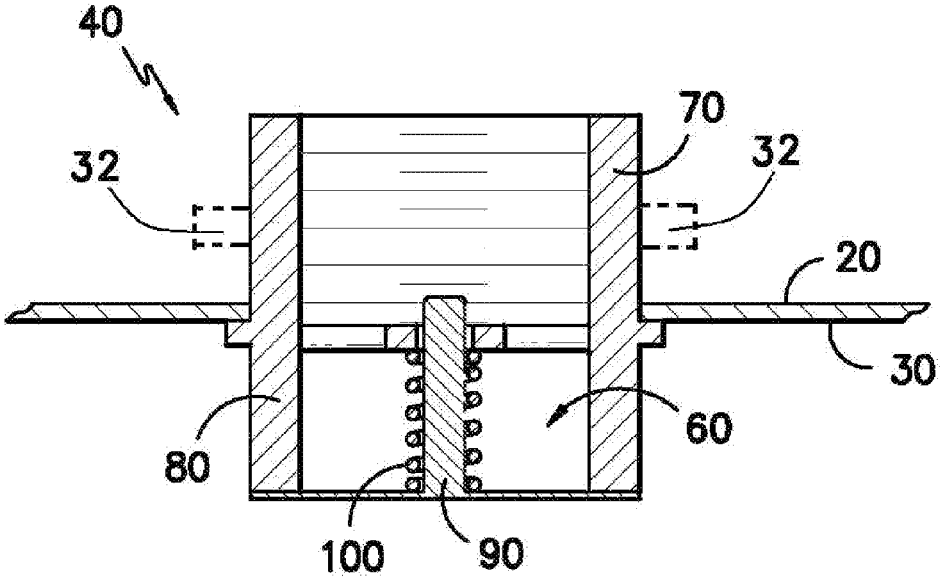
FIG. –5–
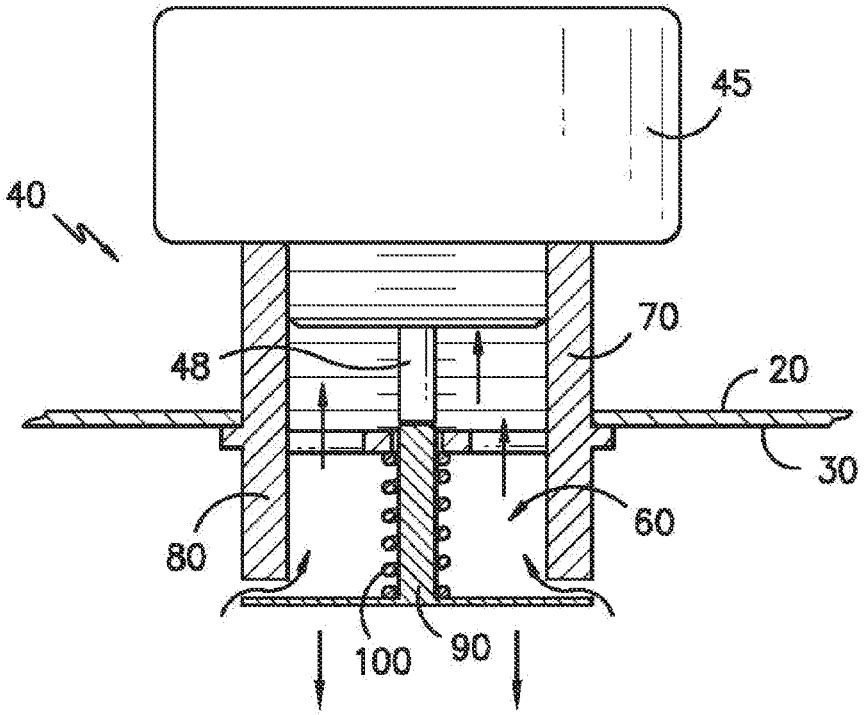
FIG. –6–

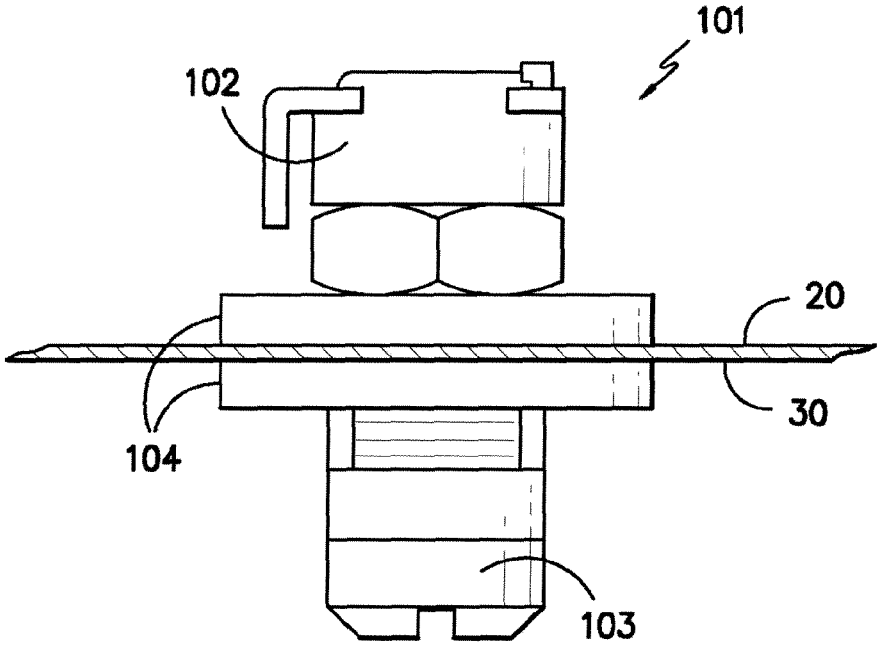
*FIG. –7–*

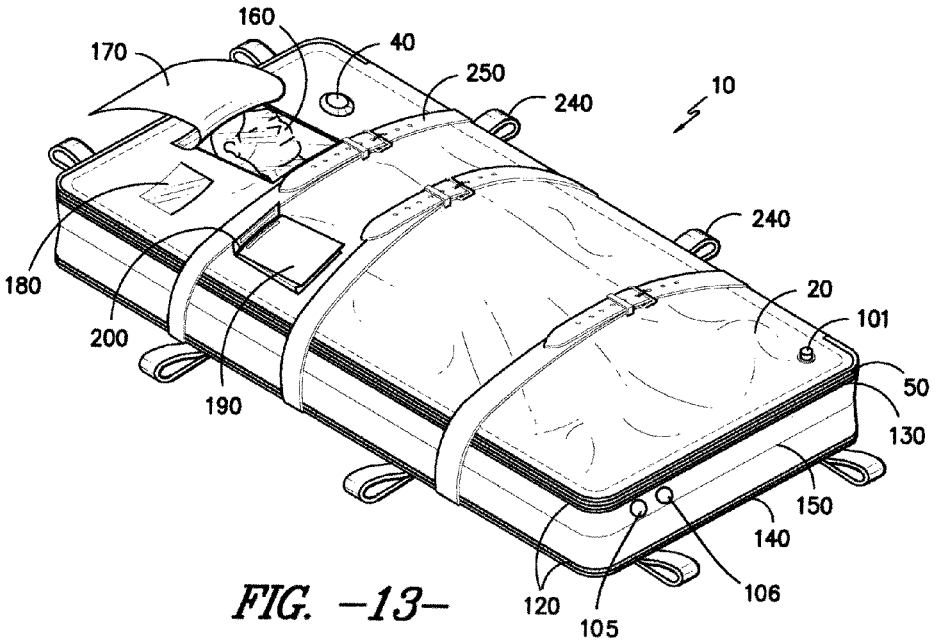
FIG. –13–

HUMAN REMAINS BAG WITH FILTRATION UNIT

FIELD OF THE INVENTION

The present invention relates generally to human remains bags or body bags with filtration and passthrough capabilities. More specifically, the present invention relates to human remains bags or body bags with replaceable filtration units.

BACKGROUND OF THE INVENTION

Human remains bags or body bags are utilized in various applications for the storage and transport of deceased humans. Fields of use include those by civilians and military, medical, mortuary, and investigative personnel. Human remains bags are traditionally designed to contain normal bodily fluids and gases resulting from natural decay and decomposition. In some instances, for example in military situations, the human remains bag must be able to maintain its integrity over an extended period of time before the human remains may be further cared for. During this extended period, bodily fluids and gases will continue to escape from the remains and be trapped within the remains bag.

SUMMARY OF THE INVENTION

According to an aspect, the present invention is directed to a container for storing a cadaver including an outer surface and an opposite, inner surface defining an internal area of the container of sufficient size to accommodate the cadaver; a closeable opening providing a passage from the outer surface to the internal area; a filtration unit including an opeanable one-way flow valve that allows for fluids (such as gases or liquids) to travel only from the internal area to the outer surface; a coupling located on the outer surface for mating with an air purifying canister or cartridge and wherein the coupling is operatively connected to the valve such that when an air purifying canister or cartridge is mated with coupling, the one-way flow valve is opened.

According to another aspect, the present invention is directed to a container for storing a cadaver including an outer surface and an opposite inner surface of sufficient size to accommodate the cadaver and defining an internal area of the container; a closeable opening providing a passage from the outer surface to the internal area; a connector on a first portion of the outer surface; a corresponding connector on a second portion of the outer surface for mating with the connector of the first portion; and a third portion on the outer surface separated by the first and second portion of the outer surface, wherein when the connector of first portion and corresponding connector of second portion are not mated, the third portion provides surface area to the outer surface of the container; and wherein when the connector of the first portion and corresponding connector of the second portion are mated, the third portion does not provide surface area to the outer surface of the container.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which:

FIG. 4 is a perspective view of the human remains bag of FIG. 1 where the bag has been opened;

FIG. 5 is a cross-sectional view of a filtration unit in accordance with an embodiment of the present invention with optional tabs;

FIG. 6 is a cross-sectional view of the filtration unit of FIG. 5 (without optional tabs), where the filtration valve is open;

FIG. 7 is a front view of a decontamination unit in accordance with an embodiment of the present invention;

FIG. 13 is a perspective view of a human remains bag in accordance with another embodiment of the present invention where the human remains bag has connection ports to allow connection to a cooling system.

Figure 1:
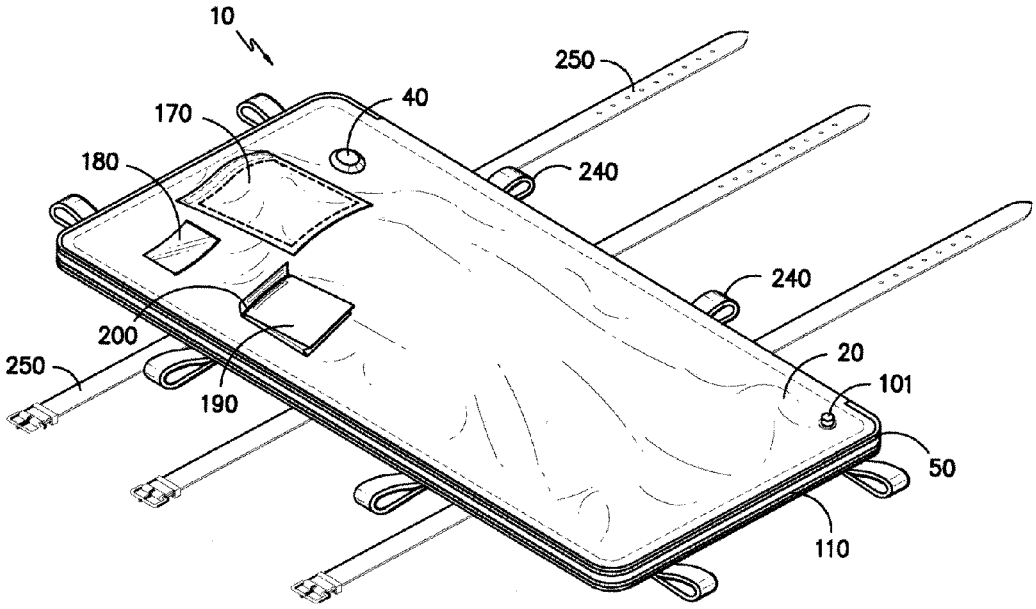
FIG. 1 is perspective view of a human remains bag in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Human remains bags in accordance with embodiments of the present invention are shown in the Figures. FIG. 1 illustrates an embodiment of human remains bag 10, in which bag 10 includes, among other items, an outer surface 20, an inner surface 30 (shown in FIG. 4), a filtration unit 40 and a closable opening 50.

Human remains bag of the present invention maintains the gases and liquids expelled from a cadaver within bag 10 and, therefore, the particular material or materials utilized for the construction of bag 10 may be chosen based on their ability to serve as a barrier to such elements. For example, in some embodiments, human remains bag 10 may be constructed of liquid and gas pervious polymeric materials, such as, but not limited to, polypropylene, polyester, polyethylene, nylon or others. In additional embodiments, human remains bag 10 may include multiple layers of differing polymeric materials and various other materials, such as a foil layer to aid in the barrier properties necessary for human remains bag 10. The user's specifications will dictate the particular materials utilized.

As indicated above, human remains bag includes a closeable opening 50. Closeable opening 50 may provide the user access to an internal portion of human remains bag 10, such that a cadaver may be placed inside, closed within the bag, and then ultimately removed from the bag. Any closeable opening 50 in the art may be utilized that is gas and/or liquid impervious. For example, a zipper or a rib-in-grove closure (similar to a Zip-Loc® bag closure), or others may be utilized, depending on the user's specifications. Closeable opening 50 may be located on any portion of human remains bag 10 that allows for adequate insertion of a cadaver and/or other human remains. For example, in some embodiments and as shown in the Figures, closeable opening 50 may be located around the sides of human remains bag 10. In additional embodiments, however, closeable opening 50 may be located on a front portion of human remains bag 10. The particular location of closeable opening 50 may be dictated by the user's specifications.

Human remains bag 10 further includes a filtration unit 40 to aid in the removal of gases from human remains bag 10. As more clearly shown in FIGS. 5 and 6, filtration unit includes a filtration valve 60 with a coupling 70 that extends from and through human remains bag outer surface 20 and inner surface 30. Filtration valve 60 further includes a valve seat 80, a plunger 90, and a spring 100 operatively connected to plunger 90. The filtration unit setup for the present invention has a one-way flow capability that is activated by the mating of an air purifying respiratory canister or cartridge 45 to coupling 70 and plunger 90. Once the canister 45 is properly situated, filtration unit 40 allows for gasses, emanating from the cadaver and that may build up in the internal area of human remains bag 10 to enter the respiratory canister 45. In addition, in other embodiments, not shown, additional ports or passthroughs could be utilized to connect a decontaminant inflow canister for sterilization of the bag contents or such passthroughs could be utilized to house the shown filtration units that provide for contaminant outflow from the human remains bag 10. The number, location, and provision of ports through the human remains bag 10 are a matter of engineering and feature choice for the designer.

In the embodiment illustrated in FIG. 5, optional holding tabs 32 are shown in dotted line form indicating that they are optional features. Such holding tabs 32 are primarily employed for the bayonet-type fittings described below. FIG. 6 does not show the optional holding tabs 32.

Respiratory canisters have an established "lifespan" that dictate the amount of time the canister can be used. After that time has passed, a new canister is necessary to avoid degradation of the canister and proper continuous filtration. By placing coupling 70 through human remains bag outer surface 20 and allowing filtration unit 40 to restrict the flow of air outside of human remains bag 10 when it is not coupled with a respiratory canister 45, the present invention allows for a user to replace the respiratory canister 45 after the established "lifespan" has passed.

Current cadaver bags utilize a valve system where a canister is placed on the inside of the bag with the cadaver. Utilizing such embodiments, however, when a canister has exceeded its "lifespan" the bag cannot be opened to replace the cartridge, as it would allow for the escape of possible harmful gases and liquids that are emitted from the cadaver and are present inside the bag. Instead, a new bag, with a new canister would have to be placed over the existing bag to ensure that no noxious gases are emitted into the atmosphere. With the configuration of filtration unit 40 as described herein, a user may avoid having to utilize an additional bag, as a canister 45 may be replaced without worry of potential dangerous gases and liquids from inside human remains bag 10 being able to escape.

With regard to the present invention, and as shown in FIGS. 5 and 6, filtration valve 60 includes plunger 90 that is biased by spring 100 against valve seat 80 such that fluids may not escape from an internal portion of human remains bag 10. As indicated above, plunger 90 is designed to mate with a standard air purifying respiratory canister or cartridge 45 on human remains bag outer surface 20 through coupling 70. Such canisters for use with human remains bag 10 could include 3M Jupiter JFR-85-CE and JFR-T1 Filters from 3M of Bracknell, Berks, United Kingdom. A source of canisters having a bayonet-type fitting as described herein is Avon Protection Systems of Cadillac, Mich.

As more clearly shown in FIG. 6, when a respiratory canister 45 is properly mated within filtration unit 40, a stem or other corresponding device 48 within respiratory canister 45 applies a downward force against plunger 90 such that fluid communication is established between the internal area of human remains bag 10 and the respiratory canister 45. However, when the respiratory canister. 45 is removed, plunger 90 returns to its settled position against valve seat 80 such that fluids may not be emitted from human remains bag 10.

Coupling 70 may be constructed to include the necessary threading to mate with the particular canisters used such that a secure fluid-tight seal is established. For example, in instances where a canister having either a Din 40 thread or a bayonet style threading is utilized, coupling 70 may be constructed with threading to appropriately mate with such canisters. In some embodiments, coupling 70 may be removable from human remains bag outer surface 20 such that a coupling 70 with the appropriate mating thread can be used in relation to the particular canister used. Such embodiments may be useful if a user has to accommodate various styles of canisters with human remains bags 10.

Although human remains bag 10 is shown with a single filtration unit, in some embodiments, human remains bag 10 may include any number of filtration units 40 based on the user's specifications. For example, in some embodiments, human remains bag 10 may include two, three, four, or more filtration units. Having additional filtration units 40 may be beneficial such that each unit 40 may include a different type of coupling 70 to properly mate with the varying canisters utilized, or canisters with differing filtration characteristics may be utilized.

In other embodiments, human remains bag may further include a filtration unit that utilizes a slide door style valve for connection of a filtration canister or cartridge. As with the plunger-type valve shown in the Figures, a slide-door valve would only allow for fluid communication between the internal and external portions of human remains bag 10 when a respiratory canister 45 is properly situated. For instance, when a canister 45 is placed over the slide-door valve, the valve may be actuated such that air from inside human remains bag 10 may be circulated within the canister 45 for proper absorption of the possibly-noxious materials inside bag 10. When the canister 45 has to be replaced, the slide-door valve may be closed by the user such that air from inside bag 10 may not escape.

In additional embodiments of the present invention, human remains bag 10 may further utilize a decontamination unit 101 (shown in FIG. 7). Decontamination unit 101 may aid in neutralizing hazardous fluids from the cadaver inside human remains bag 10. For example, in military applications, if the cadaver has been exposed to certain noxious gasses, decontamination unit 101, in association with a suitable decontaminating material, may be used to neutralize the noxious gases within human remains bag 10.

As shown in FIG. 7, decontamination unit 101 may include a connector 102 that, when installed, is located exterior of the outer surface 20 and a dispenser 103 located interior of the inner surface 30. To ensure that harmful gasses may not inadvertently escape human remains bag 10, a fluid and gas-tight gasket seal 104 may be utilized between connector 102 and dispenser 103. Connector 102 may include any type of fitting to mate with a container of decontamination material (not shown). For example, in some embodiments and as shown in FIG. 7, connector 102 may be a one-way quick connect fitting that allows for the easy connection and removal of a container from connector 102.

In addition, dispenser 103 may be any known dispensing unit to aid in distributing the decontamination material inside human remains bag 10. For example, in some embodiments and as shown in FIG. 7, if the container of decontamination material is pressurized, dispenser 103 may include a misting or fogging nozzle. In other embodiments, for example if the container of decontamination material is not pressurized, an atomizer sprayer may be utilized for dispenser 103. The user's specifications will dictate the necessary materials utilized for the decontamination unit 101.

Figure 8:
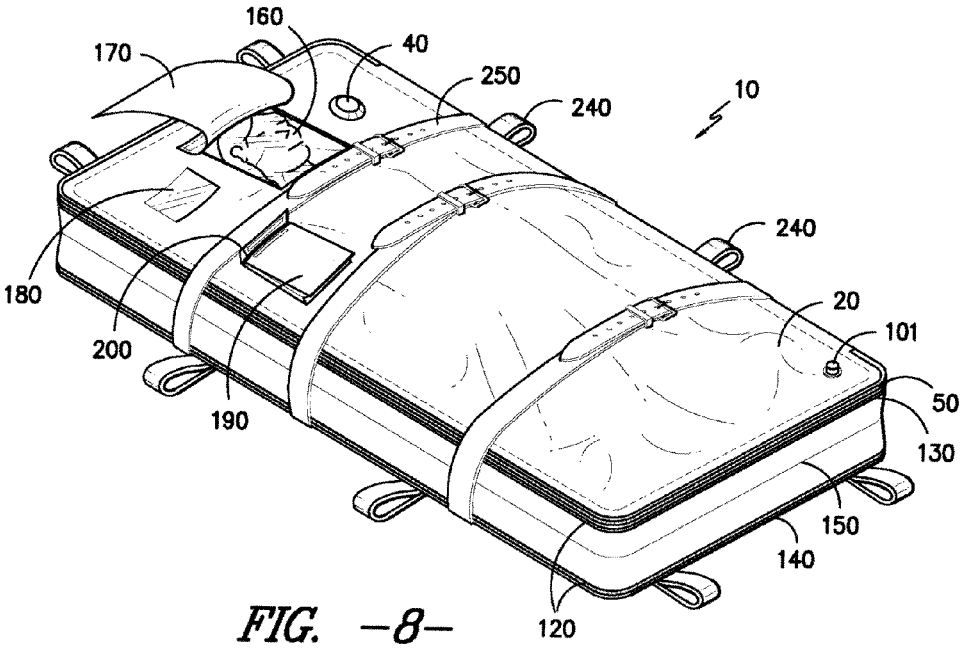
FIG. 8 is a perspective view of the human remains bag of FIG. 1, where a third portion provides surface area for the outer surface.

As shown in the Figures and as more clearly shown in FIG. 8, in some embodiments, human remains bag 10 may also be equipped with an expandable connector 110 to increase the volume of the internal portion of the human remains bag 10. Utilizing expandable connector 110, human remains bag 10 has the capability of adapting to the size of the cadaver placed in the internal portion of the human remains bag 10. In many instances, the cadavers to be collected are of varying size and a cadaver bag has to be of sufficient size to accommodate each particular cadaver. Accordingly, the size of the cadaver bag is larger and more bulky. In such instances, when a smaller cadaver is placed inside, the bag can be more difficult to carry based on the excess material that makes up the human remains bag. In addition, the excess material may make it more difficult to locate specific areas of the cadaver for proper identification.

An additional embodiment of the present human remains bag 10 is shown in FIG. 13. In particular, the human remains bag 10 of FIG. 13 allows for connection to a cooling system with fluid inflow and fluid outflow fittings of the type shown in co-pending U.S. patent application Ser. No. 12/558,121, which is incorporated herein in its entirety by reference thereto. Connection ports 105 and 106 may be configured to allow fittings, with one port being designed to allow fluid inflow and the other port being designed to allow fluid outflow, so that a fluid (such as a gas or a liquid) may be allowed to flow to a cooling pad located within the confines of the human remains bag to chill a cadaver housed therein.

Figure 9:
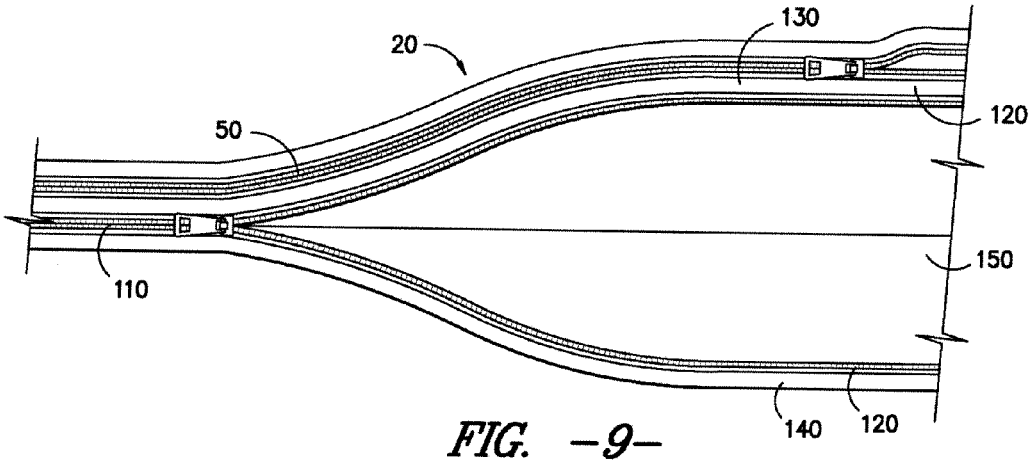
FIG. 9 is a zoomed-in view of the closeable opening and the expandable connector of the human remains bag of FIG. 1, where the third portion provides surface area for the outer surface.
Figure 10:
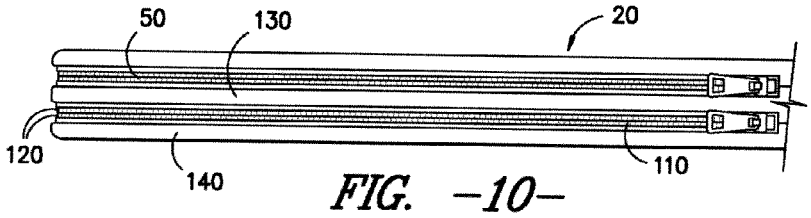
FIG. 10 is a zoomed-in view of the closeable opening and the expandable connector of the human remains bag of FIG. 1, where the third portion does not provide surface area for the outer surface.
Figure 11:
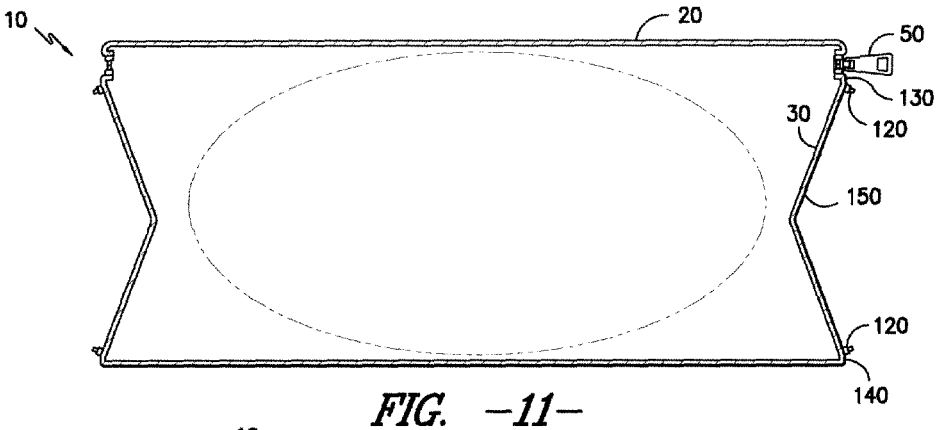
FIG. 11 is a cross-sectional view of the human remains bag of FIG. 1, where a third portion provides surface area for the outer surface.
Figure 12:
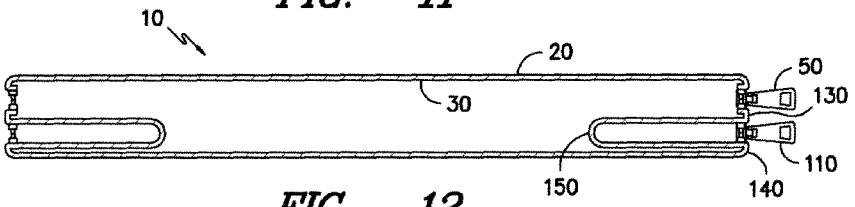
FIG. 12 is a cross-sectional view of the human remains bag of FIG. 1, where a third portion does not provide surface area for the outer surface.

As shown in FIGS. 11 and 12, the use of expandable connector 110 allows human remains bag 10 to expand and contract its internal volume based on the size of the cadaver or remains to be placed inside. As shown in FIGS. 9 and 10, expandable connector 110 is constructed of connectors 120, such as a standard zipper, Velcro, snap, ties, or other type of connector, on a first portion 130 of human remains bag 10 and a second portion 140 of human remains bag 10. As further shown in FIG. 9, human remains bag first portion 130 and second portion 140 are separated by a third portion 150 of human remains bag 10. In this instance, human remains bag 10 may be suitable to accommodate a cadaver of larger size, as third portion 150 serves as additional surface area of human remains bag 10, thereby providing additional volume to the internal portion. However, if a user necessitates a smaller volume human remains bag, the user may use connectors 120 to draw first portion and second portion 130 and 140 of human remains bag 10 together. In such instance, human remains bag third portion 150 is collapsed on itself and is positioned within the internal portion of human remains bag 10. Accordingly, in such position, third portion 150 does not serve as additional surface area of human remains bag 10 and, therefore, decreases the volume of human remains bag 10.

Figure 2:
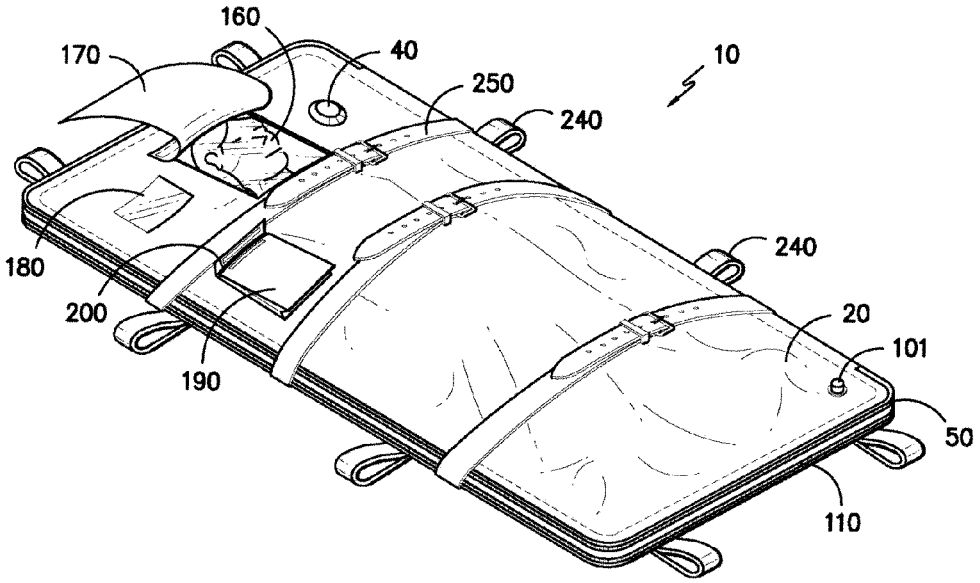
FIG. 2 is a perspective view of the human remains bag of FIG. 1, where the securing straps have been connected.

In some embodiments of the present invention, and as shown in FIG. 2, human remains bag 10 may further include a transparent portion 160 that provides visibility from an outer portion of human remains bag 10 to an inner portion, and vise-versa. In some embodiments, transparent portion 160 may be utilized to aid in the identification of the cadaver, or the possible result of death. In such instances, transparent portion 160 may be of any particular size or shape to accommodate the user's specifications. For example, if the user requires transparent portion 160 for identification, transparent portion 160 may be placed at a position that corresponds to the place where a cadaver's head would be placed. As such, a user could look through transparent portion 160 and identify the cadaver by reviewing facial features or other identifying features that may be found on the cadaver's head.

As shown in FIG. 1, in embodiments where transparent portion 160 only encompasses a portion of human remains bag 10, human remains bag 10 may be equipped with a cover member 170 that shields transparent portion 160 when desired by the user. For example, cover member 170 may be made of a non-transparent material and may be connected or fastened in a known manner to human remains bag 10, such as being sown, using connectors, etc., such that it may be moved away from transparent portion 160 but still maintain its connectivity to human remains bag 10. The cover member 170 may be fully sown around all edges as shown in FIG. 1 or attached on only one side to operate as a flap as shown in FIG. 2.

Figure 3:
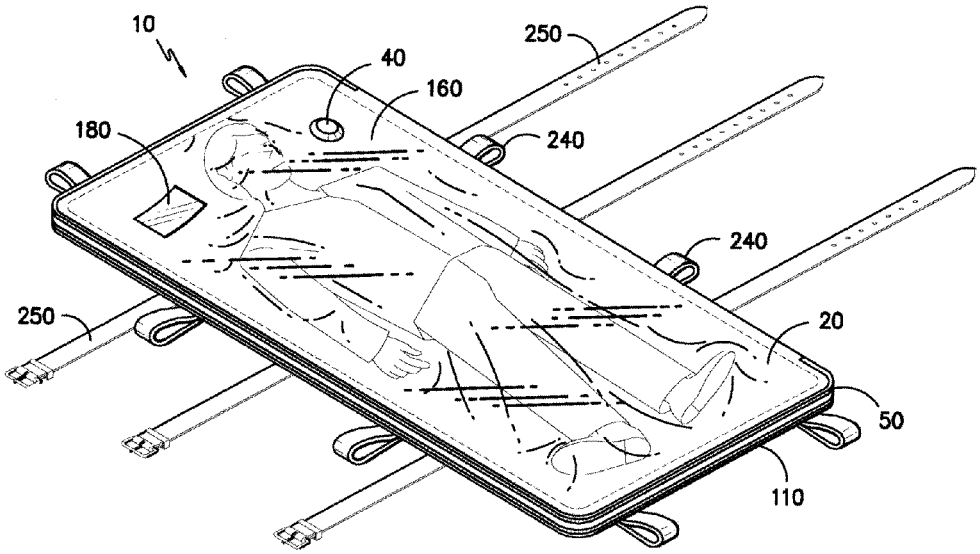
FIG. 3 is a perspective view of a human remains bag in accordance with another embodiment of the present invention where the entire outer surface is transparent.

In other embodiments of the present invention, transparent portion 160 may encompass any portion of human remains bag 10 based on the user's specifications. For example and as shown in FIG. 3, in some embodiments, human remains bag 10 may include transparent portion 160 that encompasses the entire front part of human remains bag 10. Such embodiments may also be useful for the identification of a cadaver. For example, in instances where a proper identification cannot be made by reviewing the cadaver's head, the use of transparent portion 160 that encompasses the entire upper bag surface allows the user to identify the cadaver based on other portions of the body without having to open human remains bag 10.

If an identification of the cadaver has been made, human remains bag 10, in some embodiments, may further include an identification holder 180. As shown in the Figures, such holder 180 may be made of any shape that is connected to human remains bag 10. The connection of holder 180 to human remains bag 10 may be accomplished by any known connection types in the art, for example, sowing, zipper, fasteners, adhesives, etc. As shown in the Figures, the type of shape utilized for identification holder 180 may correspond to the identification card or other identification material that is used in connection with identification holder 180. For example, if an identification card is shaped like a standard business card or automobile driver's license, holder 180 may be shaped as a rectangle to match the shape. Such correspondence of shape of the card and holder 180 may be important so that a secure fit may be accomplished, restricting the identification card's ability to be dislodged from identification holder 180.

In additional embodiments, human remains bag 10 may further include property carrier 190. In embodiments where property carrier 190 is utilized, carrier 190 may be constructed of a pouch that extends from human remains bag. In such instances, carrier 190 may include an open top 200 that allows a user to insert the cadaver's personal belongings. In such embodiments, property carrier 190 may utilize a portion of human remains bag outer surface 20 to serve as a wall of property carrier 190.

In additional embodiments where a property carrier 190 is utilized, carrier 190 may be detachable from human remains bag. In such embodiments, property carrier 190 may utilize any known connection methods in the art to connect to a portion of human remains bag outer surface 20. For example, carrier 190 may include snaps, Velcro, or ties that maintain carrier's 190 connection to human remains bag 10 when desired but allow for removal when desired. In addition, carrier 190 may include a carrier closeable opening 190 that allows for the secure placement of the cadaver's belongings. Such carrier closeable opening 190 may include a zipper, Velcro, or other forms of closeable openings.

Although property carrier 190 may be constructed from the same material as human remains bag 10, it is not imperative. For example, in some embodiments, property carrier 190 may not require the use of a material that is gas and liquid impervious like human remains bag 10. In such embodiments, based on a user's requirements for property carrier, a less expensive material may be chosen, such as poly/cotton blends or vinyl materials.

In additional embodiments, and as shown in the Figures, human remains bag 10 may further include absorbent pads 210 housed in absorbent pad carriers 220. Absorbent pads 210 may aid in accumulating any fluids that exit the cadaver, thereby reducing possibilities for leakage. In some embodiments, human remains bag 10 may include one or more pads 210 that are, for example, placed on the top and bottom of human remains bag 10 based on the placement of the cadaver. In addition, absorbent pad carriers 220 may have an open top 230 such that absorbent pads 210 may be placed within carriers 220 prior to the insertion of a cadaver. Absorbent pad carriers 220, for example, may be created from any breathable material such that fluids may seep through carriers 220 and into absorbent pads 210.

In additional embodiments and as shown in FIGS. 1-4, human remains bag may further include transport straps 240. In some embodiments, transport straps 240 may extend from outer surface 20 and may form a loop to fit a user's hand. In addition, and as shown in FIG. 1, transport straps 240 may be equally spaced around human remains bag 10 to properly adapt to a transporter. To ensure that transport straps 240 maintain the weight of bag 10, they may be constructed of materials that include up to about 1000 lb tensile strength, for example nylon or other polymeric materials. In addition, transport straps 240 may be sown to outer surface of human remains bag 10 such that as not to disrupt the integrity of human remains bag 10.

In addition to transport straps 240, human remains bag 10 may further include secure straps 250 located on outer surface 20 for fitting around a cadaver and tightening bag 10. As shown in FIGS. 1 and 2, each secure strap 250 may be mated with the use of a buckle or other tightening device. In operation, once a cadaver has been placed inside human remains bag 10, secure strap 250 may be wrapped around to a top portion of bag 10 and secured to the corresponding secure strap 250 such that human remains bag 10 may form a tighter fit around the cadaver. In embodiments of the present invention, any number of secure straps 250 may be utilized to accommodate the user. For example, in some embodiments, two, three, four or more secure straps 250 may be utilized.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the versions contained therein.

What is claimed is:

1. A human remains bag for storing a cadaver, the human remains bag comprising:

an outer surface and an opposite, inner surface defining an internal area of the human remains bag of sufficient size to accommodate the cadaver;

a closeable opening providing a passage from exterior of the outer surface to the internal area; and a passthrough unit comprising:

an openable one-way flow valve that allows for fluids to travel only from the internal area to the exterior of the outer surface;

an air purifying canister or cartridge positioned outside of the human remains bag;

a coupling located through the outer surface and inner surface that mates with the air purifying canister or cartridge;

wherein the coupling is operatively connected to the valve such that when the air purifying canister or cartridge is positioned outside of the human remains bag and is mated with the coupling, the one-way flow valve is opened so as to allow gas within the internal area to pass to the exterior of the outer surface.

2. The human remains bag of claim 1, wherein said openable one-way flow valve comprises:

a valve seat;

a plunger; and a a spring, wherein the plunger is biased by the spring to a closed position so as to make contact with the valve seat and restrict gas flow from internal area to the exterior of the outer surface; and wherein actuation of the plunger forces plunger away from the valve seat and into an open position to allowing fluid communication between the internal area and exterior of the outer surface.

3. The human remains bag of claim 1, wherein the coupling is removable.

4. The human remains bag of claim 1, wherein the passthrough unit is a filtration unit.

5. The human remains bag of claim 1, wherein the human remains bag includes two passthrough units.

6. The human remains bag of claim 5, wherein at least one of the passthrough units is a filtration unit.

7. The human remains bag of claim 1, wherein the coupling includes Din 40 thread or bayonet style thread to mate with the air purifying canister or cartridge.

8. The human remains bag of claim 1, wherein the human remains bag comprises liquid and gas impervious polymeric materials.

9. The human remains bag of claim 8, wherein the human remains bag comprises multiple layers.

10. The human remains bag of claim 1, wherein the closeable opening comprises a gas and liquid impervious zipper.

11. The human remains bag of claim 1, wherein the human remains bag comprises transport straps that extend from the outer surface and form a loop for transporting the human remains bag.

12. The human remains bag of claim 1 further defining at least two ports adapted to receive fittings to allow for fluid inflow and fluid outflow from within the human remains bag.

13. A human remains bag for storing a cadaver, the human remains bag comprising:

an outer surface and an opposite, inner surface defining an internal area of the human remains bag of sufficient size to accommodate the cadaver;

a closeable opening providing a passage from exterior of the outer surface to the internal area;

a passthrough unit comprising:

an openable one-way flow valve that allows for fluids to travel only from the internal area to the exterior of the outer surface;

an air purifying canister or cartridge positioned outside of the human remains bag;

a coupling located through the outer surface and inner surface that mates with the air purifying canister or cartridge;

a connector located adjacent a first portion of the outer surface;

a corresponding connector located adjacent a second portion of the outer surface for mating with the connector of the first portion; and a third portion of the outer surface separated by the first and second portion of the outer surface;

wherein when the connector of the first portion and the corresponding connector of the second portion are not mated, the third portion provides surface area to the outer surface of the human remains bag;

wherein when the connector of the first portion and the corresponding connector of the second portion are mated, the third portion does not provide surface area to the outer surface of the human remains bag; and wherein the coupling is operatively connected to the valve such that when the air purifying canister or cartridge is positioned outside of the human remains bag and is mated with the coupling, the one-way flow valve is opened so as to allow gas within the internal area to pass to the exterior of the outer surface.

14. The human remains bag of claim 13, wherein the connector and the corresponding connector comprise a zipper.

15. The human remains bag of claim 13, wherein connectors and corresponding connectors span an entire outer perimeter of the human remains bag.

16. The human remains bag of claim 13, wherein the human remains bag further comprises:

a secure strap connected to a portion of the outer surface and extending around the human remains bag; and a corresponding secure strap connected to another portion of the outer surface opposite the secure strap and extending around the human remains bag;

wherein secure strap and corresponding secure strap are positioned for mating and securing the human remains bag and any human remains bag contents by a tightening device.

17. The human remains bag of claim 13 further defining at least two ports adapted to receive fittings to allow for fluid inflow and fluid outflow from within the human remains bag.

18. A human remains bag for storing a cadaver, the human remains bag comprising:

an outer surface and an opposite, inner surface defining an internal area of the human remains bag of sufficient size to accommodate the cadaver;

a closeable opening providing a passage from exterior of the outer surface to the internal area;

a passthrough unit comprising:

an openable one-way flow valve that allows for fluids to travel only from the internal area to the exterior of the outer surface;

an air purifying canister or cartridge positioned outside of the human remains bag;

a coupling located through the outer surface and inner surface that mates with the air purifying canister or cartridge; and a transparent portion on the human remains bag that provides a visual viewing window from exterior of the outer surface to the internal area;

wherein the transparent portion is at least positioned at a portion of the human remains bag corresponding to where the head of a cadaver would be placed in the internal area; and wherein the coupling is operatively connected to the valve such that when the air purifying canister or cartridge is positioned outside of the human remains bag and is mated with the coupling, the one-way flow valve is opened so as to allow gas within the internal area to pass to the exterior of the outer surface.

19. The human remains bag of claim 18, wherein the transparent portion extends along a sufficient entire surface area of the human remains bag to allow the entire cadaver to be viewed from exterior of the outer surface.

20. The human remains bag of claim 18, wherein the human remains bag further comprises a cover member that selectively shields all or part of the transparent portion.

21. The human remains bag of claim 18, wherein the human remains bag further comprises an identification carrier connected to the outer surface of the human remains bag.

22. The human remains bag of claim 18, wherein the human remains bag further comprises a property carrier connected to the outer surface of the human remains bag.

* * * * *

UNITED STATES PATENT AND TRADEMARK OFFICE

CERTIFICATE OF CORRECTION

PATENT NO. : 9,216,128 B2
APPLICATION NO. : 13/827648
DATED : December 22, 2015
INVENTOR(S) : Michael P. Richardson It is certified that error appears in the above-identified patent and that said Letters Patent is hereby corrected as shown below:

IN THE SPECIFICATION

Column 3 Line 5 "liquid and gas pervious polymeric materials, such as, but not" should read -- liquid and gas impervious polymeric materials, such as, but not --.

Signed and Sealed this
Twelfth Day of April, 2016

Michelle K. Lee

Michelle K. Lee
*Director of the United States Patent and Trademark Office*